US006004227A

United States Patent [19]

Petersen

[11] Patent Number: 6,004,227

[45] Date of Patent: Dec. 21, 1999

[54] APPARATUS FOR RETRIEVING AND TEEING GOLF BALLS

[76] Inventor: Timothy M. Petersen, 745 Camino Diablo, Brentwood, Calif. 94513

[21] Appl. No.: 09/084,814

[22] Filed: May 26, 1998

Related U.S. Application Data

[63] Continuation-in-part of application No. 08/903,579, Jul. 31, 1997, abandoned.

[51] Int. Cl.[6] ..... A63B 57/00

[52] U.S. Cl. ..... 473/386; 294/19.2

[58] Field of Search ..... 473/386, 286, 473/132; 294/19.1, 19.2

[56] References Cited

U.S. PATENT DOCUMENTS

| | | | |
|---|---|---|---|
| 2,609,198 | 9/1952 | Armstrong . | |
| 3,889,946 | 6/1975 | Setecka . | |
| 4,013,295 | 3/1977 | Baughman | 473/286 |
| 4,136,901 | 1/1979 | Walter | 294/19.2 |
| 4,313,604 | 2/1982 | Baxter . | |
| 4,360,199 | 11/1982 | Jackson . | |
| 4,589,661 | 5/1986 | Attig . | |
| 4,951,947 | 8/1990 | Kopfle | 473/386 |
| 4,969,646 | 11/1990 | Tobias . | |
| 5,165,744 | 11/1992 | Vogrin . | |
| 5,310,177 | 5/1994 | Conrad et al. | 473/386 |
| 5,383,659 | 1/1995 | Taylor . | |
| 5,439,213 | 8/1995 | Pimentel . | |
| 5,494,279 | 2/1996 | Ahner . | |
| 5,499,813 | 3/1996 | Black . | |
| 5,540,432 | 7/1996 | Keller . | |
| 5,575,519 | 11/1996 | Mansbridge | 294/19.2 |
| 5,772,533 | 6/1998 | Dahlmann | 473/386 |
| 5,839,972 | 11/1998 | Swanson | 473/386 |
| 5,857,927 | 1/1999 | Driscoll et al. | 473/386 |

*Primary Examiner*—Steven Wong
*Attorney, Agent, or Firm*—Thomas R. Lampe

[57] ABSTRACT

Apparatus for retrieving and teeing golf balls includes a golf ball retrieving member in the form of an open framework having an opening at a side thereof. The golf ball is trapped within the interior of the golf ball retrieving member by rotating the golf ball retrieving member relative to the ball. A golf ball engagement member is movably mounted relative to the framework between two positions. In one of the positions the golf ball engagement member engages a golf ball within the interior of the retrieving member to retain the golf ball in place within the retrieving member interior.

12 Claims, 6 Drawing Sheets

APPARATUS FOR RETRIEVING AND TEEING GOLF BALLS

This is a continuation-in-part of U.S. patent application Ser. No. 08/903,579, filed Jul. 31, 1997 now abandoned.

TECHNICAL FIELD

This invention relates to an apparatus utilized to retrieve golf balls and also to facilitate teeing of golf balls.

BACKGROUND OF THE INVENTION

As is the case with many sports, the sport of golf requires considerable practice to attain the skills necessary to become an accomplished player. A golfer must hit many golf balls to become proficient and to develop the level of confidence required to compete with the course, opponents, and oneself.

Many golf shots employ the use of a tee and during regular practice sessions a ball may be teed up many times, requiring the golfer to bend from the waist or at the knees everytime a tee is applied to the ground and a golf ball is teed up. This expenditure of energy can be detrimental and detract from the golf shot itself. In some cases bodily injury can result.

As a consequence, numerous attempts have been made to provide devices which aid the golfer through reduction of the physical effort required to tee up a golf ball.

The following United States Patents disclose devices which are believed to be representative of the current state of the art in this field: U.S. Pat. Nos. 3,889,946, 2,609,198, 5,165,744, 5,439,213, 4,589,661, 5,499,813, 5,540,432, 5,494,279, 5,383,659, 4,969,646, 4,360,199, and 4,313,604.

The devices disclosed in the above-identified United States patents have one or more of the following deficiencies and disadvantages:

(a) Manufacturing cost is high because of the complexity of the device and materials used;

(b) Many structural components and complex structural inter-relationships are required to accomplish the intended task;

(c) Considerable time must be employed to accomplish the task;

(d) The mechanism is awkward to use or is not reliable insofar as operation is concerned; and (e) Use is limited; for example, use is limited to just teeing a golf ball.

DISCLOSURE OF INVENTION

The present invention relates to an apparatus which can be readily employed to perform a plurality of tasks including both retrieving golf balls and teeing golf balls. The device is characterized by its relative simplicity and inexpense, ease of use and reliability of operation.

The apparatus for retrieving and teeing golf balls constructed in accordance with the teachings of the present invention includes a golf ball retrieving member defining a retrieving member interior and an opening at the side thereof communicating with the retrieving member interior and sized to permit passage of a golf ball therethrough.

The golf ball retrieving member includes a golf ball support element for positioning under a golf ball having an inclined support surface for supporting the golf ball and directing the golf ball into the retrieving member interior through the opening responsive to rotational movement of the retrieving member. The golf ball retrieving member accommodates the golf ball within the retrieving member interior after the rotational movement.

The apparatus additionally includes a golf ball engagement member movably mounted relative to the golf ball retrieving member. The golf ball engagement member is movable between a golf ball engagement position wherein the golf ball engagement member engages a golf ball within the retrieving member interior to retain the golf ball in the retrieving member interior and an inactive position wherein the golf ball engagement member is disengaged from the golf ball.

Means is provided for selectively moving the golf ball engagement member between the golf ball engagement position and the inactive position.

Other features, advantages, and objects of the present invention will become apparent with reference to the following description and accompanying drawings.

MODES FOR CARRYING OUT THE INVENTION

Figure 2:
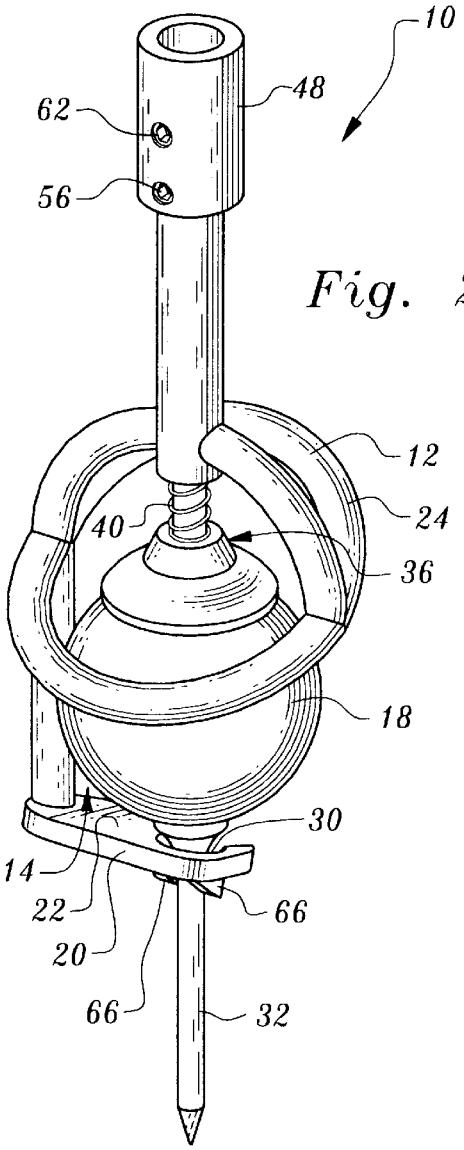
FIG. 2 is an enlarged perspective view illustrating the apparatus holding a golf ball and tee.

Referring now to FIGS. 1–14, apparatus constructed in accordance with the teachings of the present invention is generally designated by reference numeral number 10.

Apparatus 10 includes a golf ball retrieving member in the form of an open framework 12 defining a retrieving member interior 14 and an opening 16 at a side of the framework communicating with the interior 14 and sized to permit passage of a golf ball 18 therethrough.

The golf ball retrieving member or framework 12 includes a golf ball support element 20 having an inclined support surface 22 sloping downwardly in the direction of opening 16, the golf ball support element 20 partially defining such opening. The opening 16, at the upper end thereof, is defined by a curved portion or golf ball contact element, 24 which slants downwardly in the direction of interior 14.

Golf ball support element 20 defines a recess 30 which can accommodate therein a tee 32 with the head of the tee 32 disposed in interior 14.

A golf ball engagement member 36 is movably mounted relative to the golf ball retrieving member 12 and movable between an extended or golf ball engagement position (shown in FIGS. 1 and 8, for example) wherein the golf ball engagement member engages a golf ball within the retrieving member interior to retain the golf ball in the retrieving member interior and an inactive or retracted position wherein the golf ball engagement member is disengaged from the golf ball. The golf ball engagement member is continuously biased toward the golf ball engagement position (or extended position) by a spring 40.

The golf ball engagement member 36 includes a reciprocating elongated member or rod 44 and a golf ball engagement cup 46 attached to member 44.

The elongated member 44 is reciprocally mounted within a tubular-shaped connector 48 extending from the top of the framework 12. A C-ring 50 or other suitable means is employed to limit downward movement of the elongated member or rod 44 due to engagement of the C-ring with a circular shaped shelf formed within connector 48 and surrounding the elongated member.

At the upper end at least, the rod or elongated member 44 is formed of steel or other suitable material attracted to a magnet. A magnet 54 is located within the connector 48 and held in place by a set screw 56. When the top end of the elongated member or rod 44 engages magnet 54, the pull of the magnet will overcome the bias of spring 40, thus maintaining the golf ball engagement member in its retracted position wherein engagement is not had with the golf ball 18.

Figure 1:
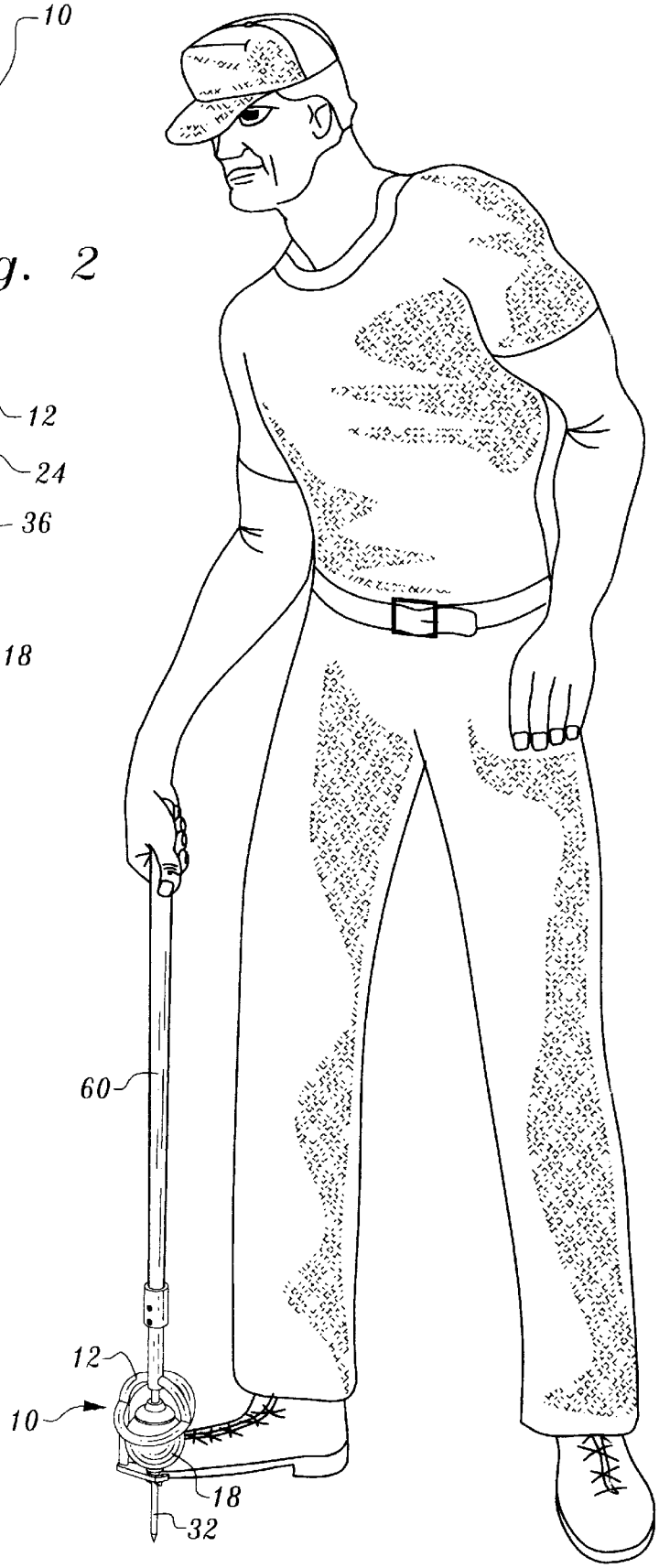
FIG. 1 is a perspective view of apparatus constructed in accordance with the teachings of the present invention being employed by a golfer to set in place a golf ball and tee.
Figure 6:
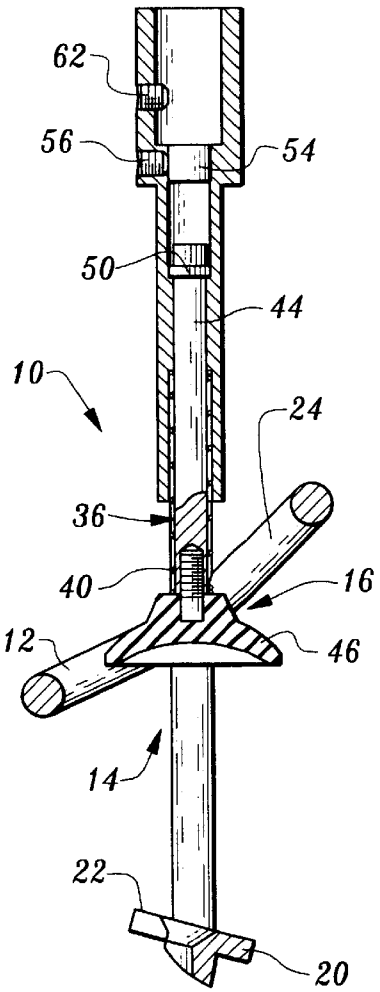
FIG. 6 is a cross-sectional view taken along the line 6—6 of FIG. 5.
Figure 5:
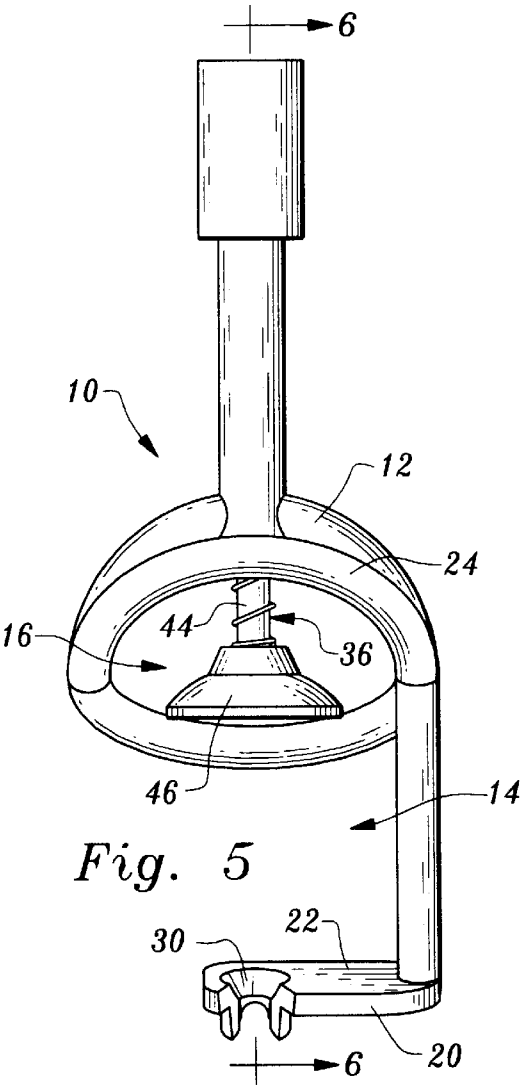
FIG. 5 is a elevational side view of the apparatus.
Figure 4:
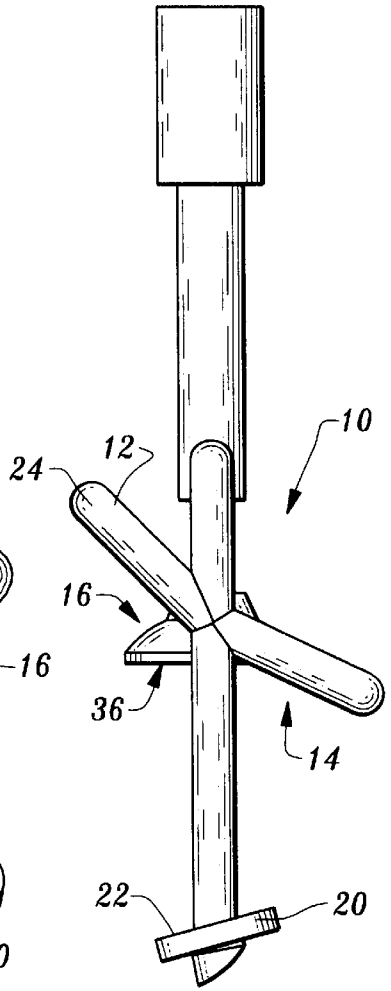
FIG. 4 is a rear elevation view of the apparatus.
Figure 3:
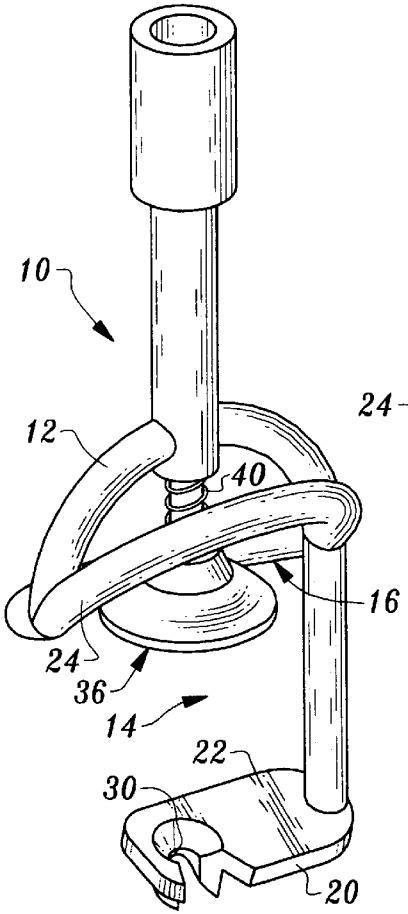
FIG. 3 is a perspective view of the apparatus without the golf ball and tee.
Figure 7:
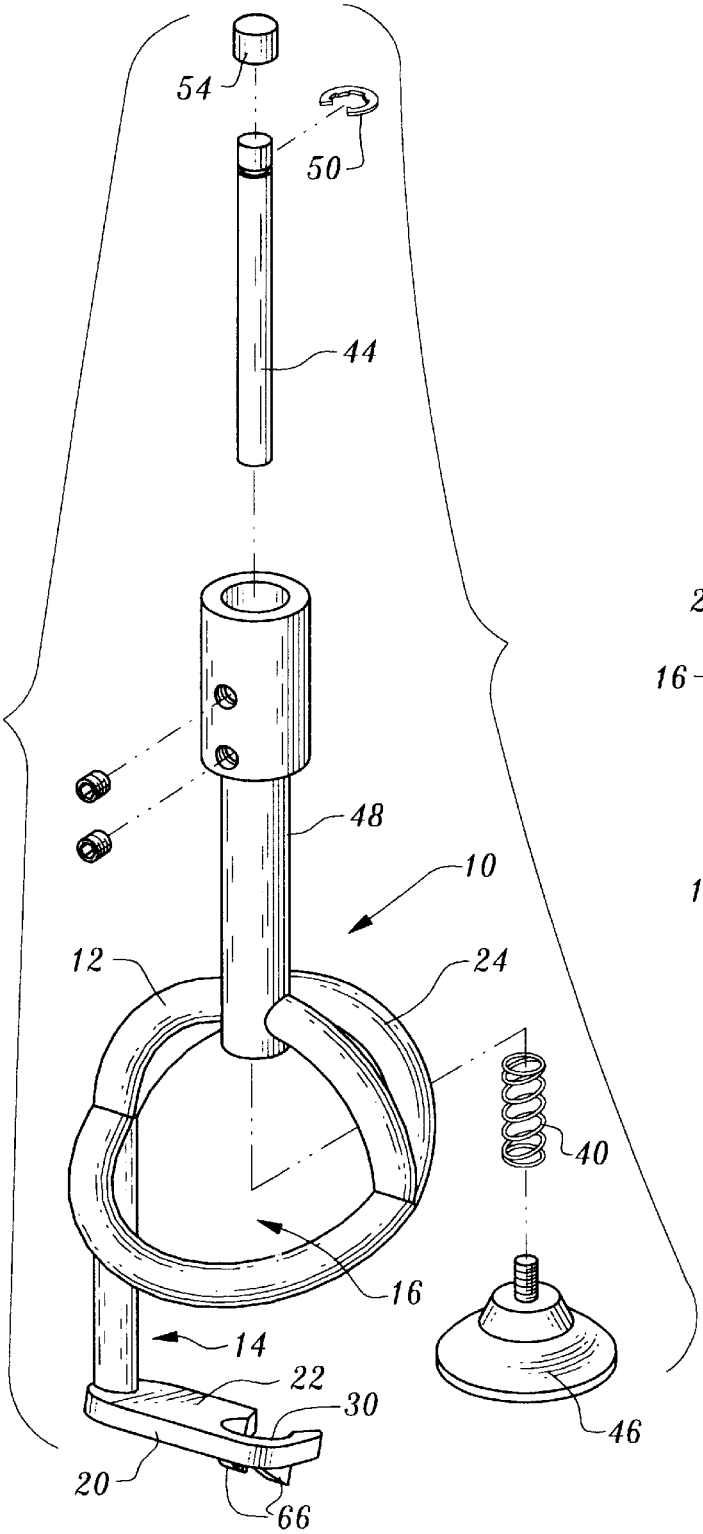
FIG. 7 is an exploded, perspective view illustrating components of the apparatus.

Connector 48 may be used to attach the framework 12 and related structure to a handle 60 (FIG. 1). A set screw 62 is suitably employed to attach the handle 60 to the connector 48.

Figure 12:
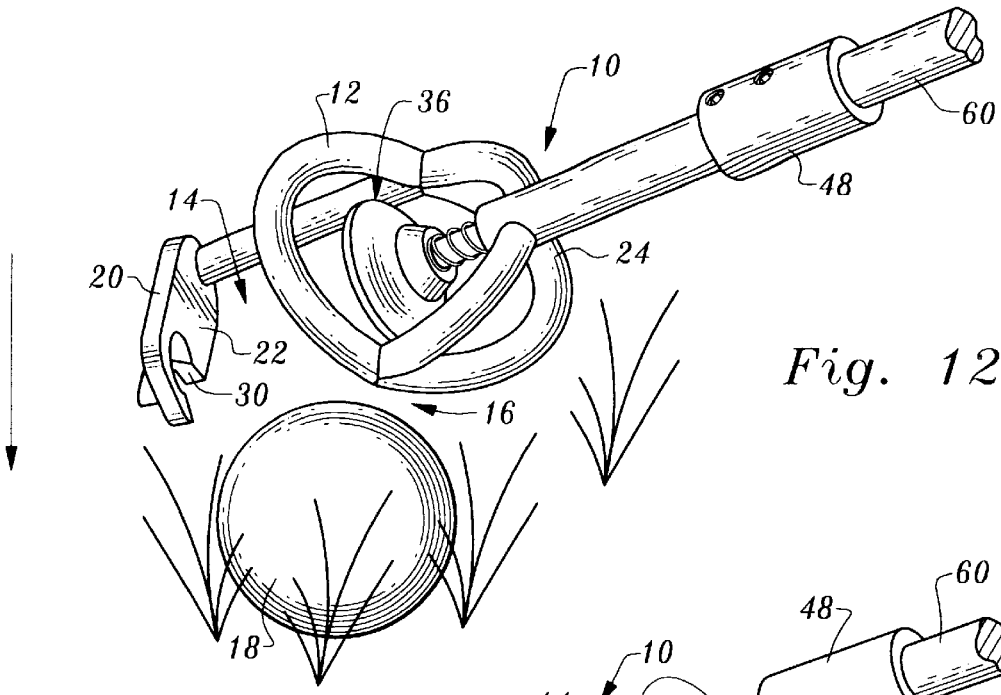
FIGS. 12 through 14 are perspective views illustrating sequential steps of retrieving a golf ball through use of the apparatus.
Figure 13:
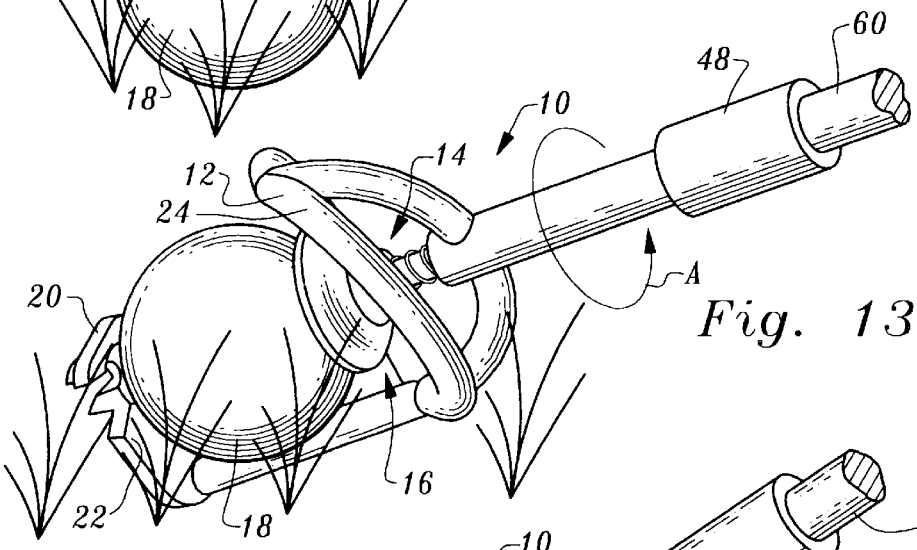
Figure 14:
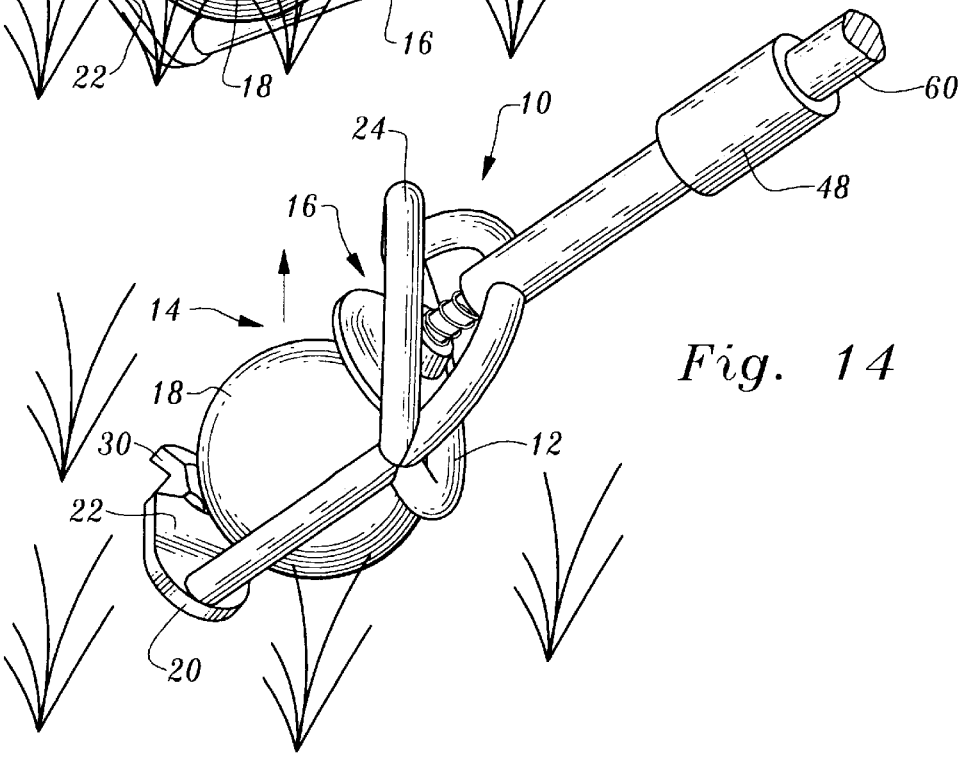

The apparatus 10 can readily be employed to both retrieve golf balls and to tee golf balls. FIGS. 12 through 14 provide a good illustration of how the device is utilized to retrieve a golf ball.

In FIG. 12 the apparatus is lowered over a golf ball 18 and the golf ball enters the framework 12 through opening 16. It is to be understood that the golf ball engagement member 36 is in its retracted or inoperable position at this time.

FIG. 13 illustrates the golf ball support element 20 positioned under the golf ball and the apparatus is rotated as shown by the arrow A so that the inclined support surface 22 of the golf ball support element assists in the positioning of the golf ball within the interior 14.

Further rotation of the apparatus will bring it to the position shown in FIG. 14 wherein the opening 16 is directed upwardly and the golf ball is essentially trapped in place within the framework interior and engages the framework so that the ball can be lifted in position as indicated by the arrow B in FIG. 14. It will be appreciated that the voids or open areas of the cage-like framework allow the golfer to readily observe operation of the device relative to the golf ball.

Figure 8:
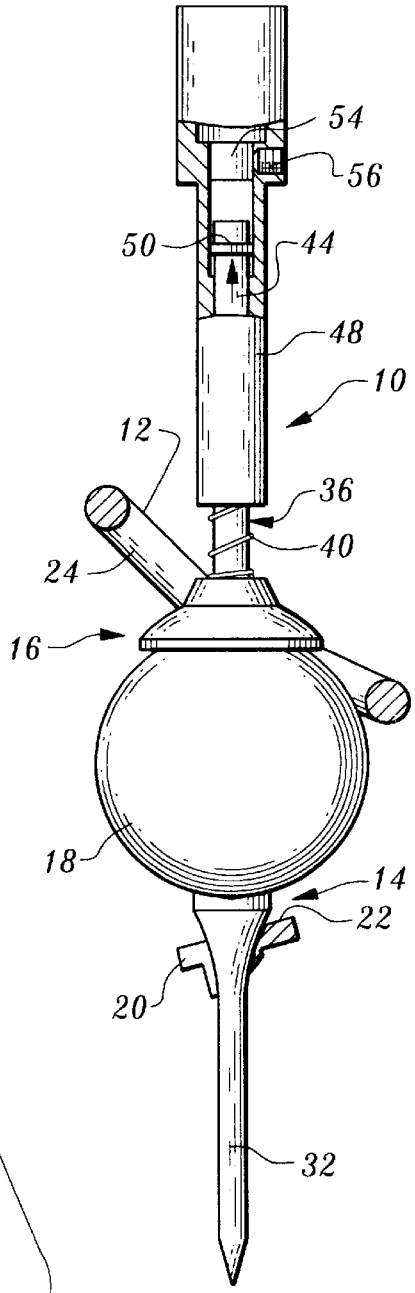
FIG. 8 is an elevational view illustrating selected components in partial cross-section and further illustrating a golf ball and tee being held by the apparatus.

One wishing to tee up the golf ball positions a tee 32 in recess 30 of the golf ball support element 20 and then manually pulls the golf ball engagement member 36 downwardly to release the rod or elongated member 44 from magnet 54 so that the golf ball 18 is maintained in position within framework 12 by the tee and cup 46. This is shown in FIG. 8, for example.

Figures 9, 10, 11:
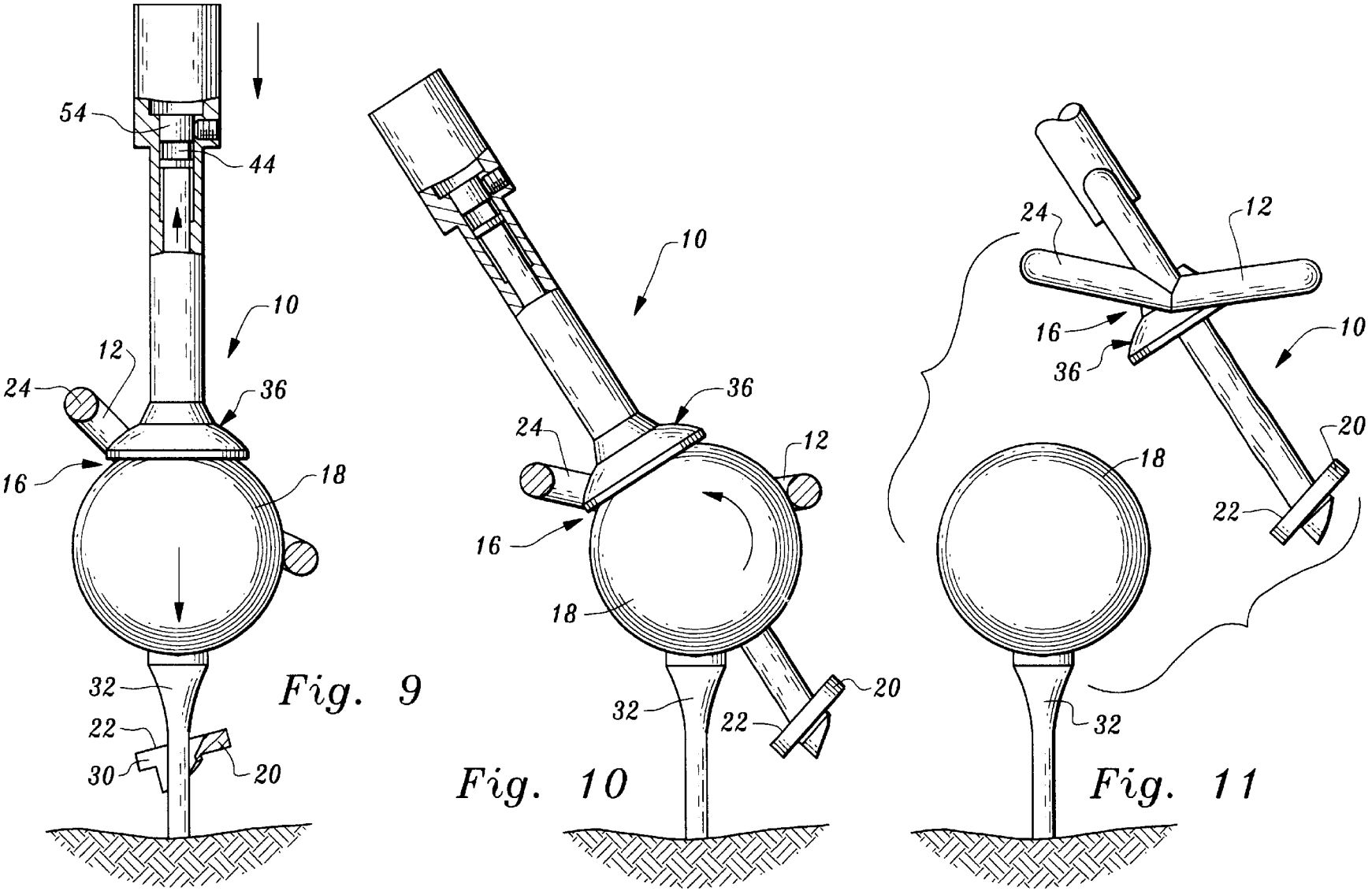
FIG. 9 is a view similar to FIG. 8 but illustrating the tee being inserted in the ground.
FIG. 10 is a view similar to FIG. 9 illustrating the relative positions assumed by the apparatus components, ball and tee after the tee has been inserted in the ground and just prior to release of the ball from the apparatus.
FIG. 11 is a perspective view illustrating the apparatus completely disengaged from both the ball and tee after the ball and tee have been positioned thereby.

FIG. 9 shows the device being utilized to position tee 32 and golf ball 18 in location for a golf shot. The apparatus is pushed downwardly by the operator and the downward force exerted on the golf ball and the tee drives the tee into the ground, as shown. The downward force will cause the golf ball engagement member 36 to move to its retracted position and elongated member or rod 44 to engage magnet 54. Now the apparatus is moved to the inclined position shown in FIG. 10 so that the ball 18 exits interior 14 through opening 16. FIG. 11 illustrates the apparatus completely disengaged from the ball and tee. The open character of the framework 12 provides the golfer with a clear view of this operation.

Projecting downwardly from framework 12 is a tee clamp in the form of spaced clamp fingers 66. These fingers may be utilized to retrieve a tee lying on its side on the ground, this being accomplished simply by wedging the tee body into the space between the finger 66. The apparatus can also retrieve tees projecting upwardly from the ground. This is accomplished by placing the tee in recess 30 and exerting an upward force on the tee with golf ball support element 20.

Figure 15:
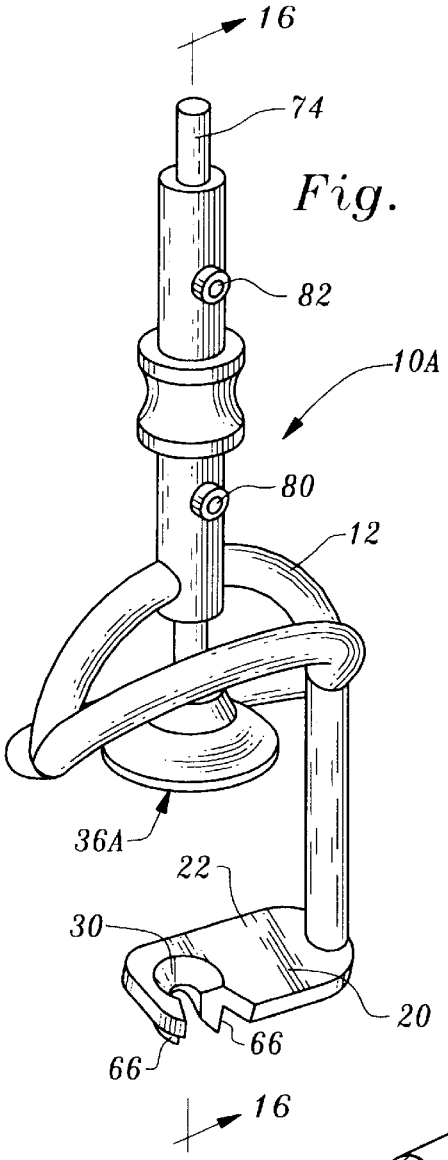
FIG. 15 is a perspective view of an alternative embodiment of the apparatus.
Figure 16:
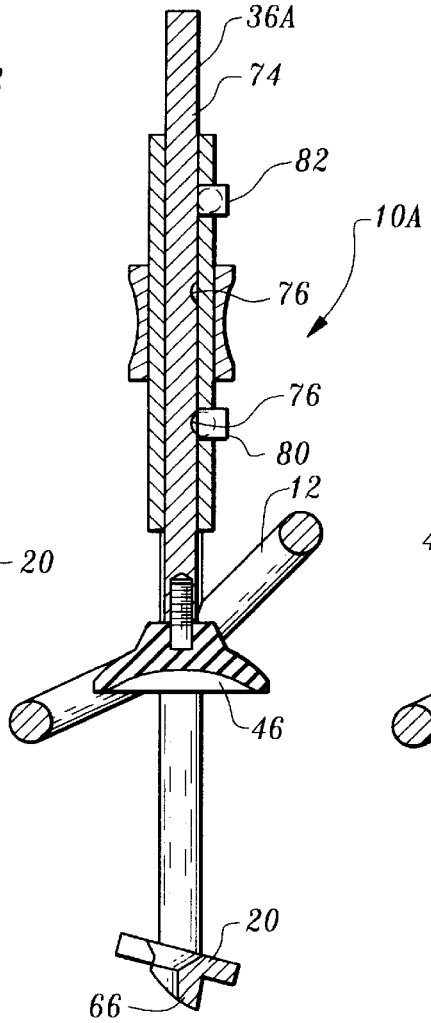
FIG. 16 is a cross-sectional view taken along the line 16—16 of FIG. 15.
Figure 17:
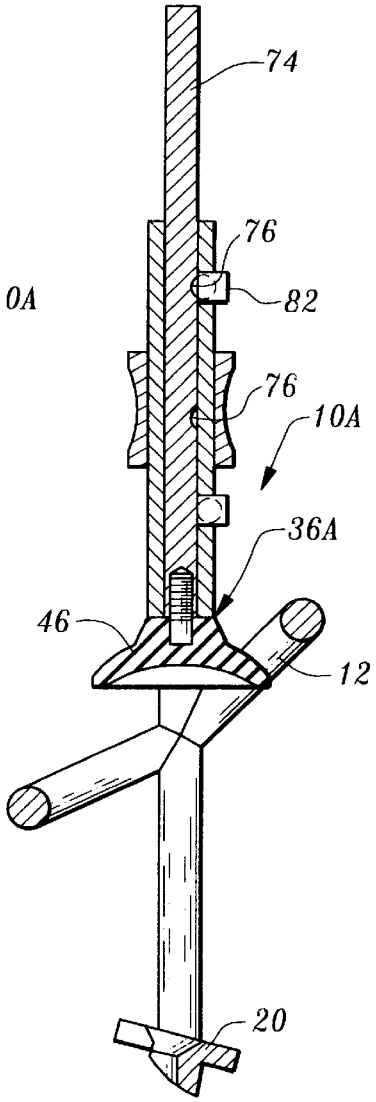
FIG. 17 is a view similar to FIG. 16 but illustrating components of the apparatus in different relative positions.

FIGS. 15 through 17 illustrate an alternative embodiment of the invention, apparatus 10A. In this embodiment of the invention, golf ball engagement member 36A has a reciprocating elongated member or rod 74 with two indents 76 formed therein and spaced from one another. When the cup 46 is in its extended or ball engaging position shown in FIG. 16, a detent 80 will enter the lowermost indent 76 and serve to retain the cup in such position. When the operator wishes to move the golf ball engagement member 36A to its retracted or inoperative position a manual force is exerted which will move the golf ball engagement member upwardly until a detent 82 enters the upper indent 76. This is shown in FIG. 17. By application of a manual force in the reverse direction the golf ball engagement member 36A can be moved downwardly.

I claim:

1. Apparatus for retrieving and teeing golf balls, said apparatus comprising, in combination:

a golf ball retrieving member defining a retrieving member interior and an opening communicating with said retrieving member interior and sized to permit passage of a golf ball therethrough, said golf ball retrieving member including a golf ball support element for positioning under a golf ball having an inclined support surface for supporting the golf ball and directing the golf ball into said retrieving member interior through said opening responsive to rotational movement of said retrieving member, said golf ball retrieving member accommodating the golf ball within the retrieving member interior after said rotational movement;

a golf ball engagement member movably mounted relative to said golf ball retrieving member and movable between a golf ball engagement position wherein said golf ball engagement member engages a golf ball within said retrieving member interior to retain the golf ball in said retrieving member interior and an inactive position wherein said golf ball engagement member is disengaged from the golf ball;

means for selectively moving said golf ball engagement member between said golf ball engagement position and said inactive position; and retention means for releasably retaining said golf ball engagement member at said inactive position.

2. The apparatus according to claim 1 wherein said golf ball retrieving member comprises an open framework defining open areas for visually observing a golf ball within said retrieving member interior from locations external of said golf ball retrieving member.

3. The apparatus according to claim 1 wherein said golf ball support element defines a recess for releasably connecting a golf tee to said golf ball retrieving member with the upper end of said golf tee located within said retrieving member interior.

4. The apparatus according to claim 1 wherein said golf ball retrieving member additionally comprises an inclined golf ball contact element spaced from said golf ball support element for contacting a golf ball, said golf ball contact member partially defining said opening and cooperable with said golf ball support element to entrap the golf ball within said retrieving member interior responsive to rotation of said golf ball retrieving member.

5. The apparatus according to claim 1 additionally comprising biasing means biasing said golf ball engagement member toward said golf ball support element.

6. The apparatus according to claim 1 wherein said retention means comprises a magnet magnetically attracted to said golf ball engagement member.

7. The apparatus according to claim 5 wherein said golf ball engagement member includes a reciprocating elongated member and a golf ball engagement cup attached thereto, said biasing means comprising a spring connected to said golf ball engagement member.

8. The apparatus according to claim 1 additionally comprising a golf tee clamp connected to and extending downwardly from said golf ball retrieving member to clampingly engage a golf tee and allow retrieval of the golf tee from the ground.

9. The apparatus according to claim 1 additionally comprising a connector attached to said golf ball retrieving member for connecting said golf ball retrieving member to a handle.

10. The apparatus according to claim 9 wherein said connector includes a hollow shaft, said golf ball engagement member being movably mounted within said hollow shaft.

11. The apparatus according to claim 1 wherein said retention means includes detent means.

12. Apparatus for retrieving and teeing golf balls, said apparatus comprising, in combination:

a golf ball retrieving member defining a retrieving member interior and an opening communicating with said retrieving member interior and sized to permit passage of a golf ball therethrough, said golf ball retrieving member including a golf ball support element for positioning under a golf ball having an inclined support surface for supporting the golf ball and directing the golf ball into said retrieving member interior through said opening responsive to rotational movement of said retrieving member, said golf ball retrieving member accommodating the golf ball within the retrieving member interior after said rotational movement;

a golf ball engagement member movably mounted relative to said golf ball retrieving member and movable between a golf ball engagement position wherein said golf ball engagement member engages a golf ball within said retrieving member interior to retain the golf ball in said retrieving member interior and an inactive position wherein said golf ball engagement member is disengaged from the golf ball; and means for selectively moving said golf ball engagement member between said golf ball engagement position and said inactive position, said golf ball retrieving member comprising an open framework defining open areas for visually observing a golf ball within said retrieving member interior from locations external of said golf ball retrieving member, said open framework including said golf ball support element and an inclined golf ball contact element spaced from said golf ball support element and fixed in position relative thereto for contacting a golf ball, said golf ball contact member partially defining said opening and cooperable with said golf ball support element to entrap the golf ball within said retrieving member interior responsive to rotation of said golf ball retrieving member, said inclined golf ball contact element and the inclined support surface of said, golf ball support element converging toward one another in a direction leading away from the opening to form an open area in said framework spaced from the opening smaller than the outer dimensions of a golf ball.

* * * * *